US005284813A

United States Patent [19]

Heyer

[11] Patent Number: 5,284,813

[45] Date of Patent: Feb. 8, 1994

[54] FIRST SHEET FOR COPYSETS

[75] Inventor: Horst W. Heyer, Mönchengladbach, Fed. Rep. of Germany

[73] Assignee: Feldmühle Aktiengesellschaft, Düsseldorf, Fed. Rep. of Germany

[21] Appl. No.: 777,358

[22] PCT Filed: Jun. 13, 1990

[86] PCT No.: PCT/EP90/00928

§ 371 Date: Dec. 3, 1991

§ 102(e) Date: Dec. 3, 1991

[87] PCT Pub. No.: WO90/15719

PCT Pub. Date: Dec. 27, 1990

[30] Foreign Application Priority Data

Jun. 16, 1989 [DE] Fed. Rep. of Germany ..... 3919736

[51] Int. Cl.[5] ..... B41M 5/124

[52] U.S. Cl. ..... 503/209; 503/215; 503/226

[58] Field of Search ..... 503/200, 226, 209, 215; 427/152

[56] References Cited

U.S. PATENT DOCUMENTS 4,448,445 5/1984 Chang et al. ..... 503/226

FOREIGN PATENT DOCUMENTS 274886 7/1988 European Pat. Off. ..... 503/226

*Primary Examiner*—Pamela R. Schwartz

*Attorney, Agent, or Firm*—Felfe & Lynch

[57] ABSTRACT

The upper surface of an upper sheet for a carbon copy system made of pressure-sensitive self-copying paper has a layer, designed to be printed on, made of pigment, binder and water-repelling agent, to increase the opacity and control the bonding properties for ease of sheet detachment.

7 Claims, No Drawings

FIRST SHEET FOR COPYSETS

FIELD OF THE INVENTION

The invention relates to a first sheet for copysets of pressure-sensitive copying papers in accordance with the introductory part of claim 1.

BACKGROUND OF THE INVENTION

Such first sheets, which are also sold under the name "CB forms," are known. The trend toward making such first sheets of constantly lower weight per unit area has brought the result that the opacity of such papers leaves something to be desired. Particularly when the microsphere coated back of the first sheet is also imprinted, the printing is visible through the thin paper and spoils the appearance of the front side.

Attempts have been made to improve the opacity of such papers by increasing the filler content in the first sheet and also by putting a nonreactive coating on the front. But it has been found that conventional coatings can improve the opacity and printability of the front side, but the easy divisibility required in copysets is lost.

By "easy divisibility" the following is meant. A copyset consists as a rule of a first sheet (CB), one or more middle sheets (CFB) and a back sheet (CF). For use, several of these sets are assembled into a block and cemented together at one narrow side. The adhesion of the glue for proper separation of one set at a time from the block, between the CF back and the CB top, must be less than it is between the CB bottom and CFB top and the CFB bottom and CF top. In the case of uncoated-surface first sheets the problem was solved by adjustment by means of surface preparation or by controlling the absorptiveness of the backs. Such measures failed, however, in the case of first sheets whose front surface was coated with pigments.

EP-A-0 274 886 proposed to provide the coated front additionally with a synthetic, reactive size or with a coating-texturing agent or with both agents, in order to assure easy divisibility.

A disadvantage of this proposal is that synthetic reactive sizes require, for complete curing, a certain time of exposure to a temperature range above 100° C. If this is not provided, e.g., when the coating unit runs too fast, or if the drying capacity of the coating unit constitutes a bottleneck, the synthetic size does not cure, with the result that the moisture repellency or adhesive repellency necessary for the easy-division adhesive on the CB sheet provided with an imprintable front surface coating is not achieved.

OBJECT OF THE INVENTION

The present invention therefore has set for itself the object of making available a first sheet for copysets of pressure-sensitive copy papers which will not have the disadvantages listed above, and will have a constant degree of moisture repellency independent of the drying conditions and will therefore permit a reliable easy-division sizing.

DESCRIPTION OF THE INVENTION

This object is achieved in a first sheet according to the generic part of claim 1 in that the front coating contains nonreactive moisture-repellent agent in a proportion of 5 to 15 wt % with respect to the dry content of the coating.

Nonreactive moisture-repellent agents, such as wax sizes, wax emulsions, metal salts of fatty acids, such as stearic acid, ester waxes, oxidized polyethylenes, copolymer dispersions and dispersions of organic prepolymers, are known in themselves and have heretofore been used in paper technology mainly in combination with glutinized starch in sizing liquids for application in the sizing press within the paper machine; see "Handbuch der Papier- und Pappefabrikation," 1971, pages 1282 ff. under the heading, "Oberflächenleimung," giving additional literature references.

Wax sizes as well as metal salts and ammonium salts of fatty acids, especially stearic acid, are used individually also in coating inks for printing papers in order to improve the inherent slipperiness of the sizing pigments in calendering, the condition of the printing ink in the printing process, and the so-called "dusting." The amount used in the coating ink was limited to 0.3 to 1.2 wt % absolutely dry, with respect to the dry content of the coating ink.

Use is made of this knowledge in EP-A-0 274 886, in that, on page 5, lines 42 and 43, lubricants, especially calcium stearates, are named as additional ink additives, stating the content in Examples 2 to 6 and 8 as 0.5 wt % each. No improvement of the easy divisibility by the addition of calcium stearate is suggested by this disclosure.

It has now surprisingly been found that first sheets for copysets of pressure-sensitive copy papers can be made available with an excellent front side printability and a good separability of the sets if the content of the nonreactive moisture repellent agent in the front coating is between 5 and 15 wt % with respect to the dry content of the coating. The term, "nonreactive moisture repellent agents," as used herein, are to be considered those additives to the coating ink for the front face coating, which after application of the coating ink and the subsequent drying, require no further components, such as hardeners or crosslinking agents, for example, and do not require a high temperature and time for reaction with hydroxyl groups and for the development of the moisture-repellent effect.

The calcium or sodium salt of a fatty acid, such as stearic acid, for example, can be used as a nonreactive moisture repellent agent. The ammonium salt of stearic acid has proven especially desirable, but it is to be noted that, at higher percentages, the viscosity of the coating ink made with it increases, so that the person skilled in the art must choose from among the metering squeegee units the necessary units for applying the coating.

Other usable moisture repellents are mixtures of gloss-producing ester waxes and oxidized polyethylenes of low molecular weight. Such mixtures are commercially available in the form of aqueous dispersions with a solid content of 30 wt %, an average particle size of 0.2 μm and a Ph of 8.5 to 9.0 and are sold under the trademark name "Wükonil PW."

Another usable nonreactive moisture repellent is represented by the so-called montan wax size prepared from montan wax, especially in its bleached form. Additional information on montan wax sizes is given in "Wochenblatt für Papierfabrikation" 82 (1954), page 623.

Another nonreactive moisture repellent agent is available in the form of an aqueous dispersion of an organic prepolymer, as it is described in the technical bulletin of Schill & Seilacher, under the product name, "UKASOL NL." These moisture repellent agents can be used in accordance with the invention singly or in mixtures with one another.

Natural pigments for face-side coating can be any pigments known in the paper coating technology, such as kaolin, calcined kaolin, ground or precipitated calcium carbonate or talc, along or in mixture together with a conventional binder such as styrene butadiene latex. No limits are placed on the person skilled in the art: he will select the pigments according to requirements as to whiteness, gloss and necessary smoothness of the coating on the front side of the first sheet.

The percentage of these natural pigments in the total pigment mixture is in itself freely selectable, but it is preferably 70 to 90 weight-parts per 100 weight-parts of absolutely dry pigment mixture.

The face coating also contains synthetic pigments, such as precipitated silica, titanium dioxide or finely divided aluminum hydroxide in addition to the natural pigments singly or in mixtures. The choice is governed by the printability requirements and by the desired final whiteness of the coating. If a high opacity is to be achieved, titanium dioxide is the indicated pigment. If the oil adsorption of the printing ink must meet special requirements, the addition of precipitated silica is recommended.

The content of the synthetic pigments amounts preferably to 10 to 30 weight-parts per 100 weight parts total pigment mixture.

As illustrated in Table 1 below, the face coating also contains dispersants and optical brighteners.

The selection of the applied weight of the face coating is at the option of the technician. It has been found that in such first sheets an applied weight of less than 4 $g/m^2$ considered as dry does not lead to the desired success as regards opacity, whiteness and printability improvement. If, however, the applied weight is selected too high (over 12 $g/m^2$), the print-through qualities of the first sheet are impaired. It has therefore proven advantageous to select an applied weight between 4 and 10 $g/m^2$. Especially preferred is an applied weight of 5 to 7 $g/m^2$.

In the following examples I to IV formulas are described for the front surface coating of first sheets in accordance with the invention, which contain different moisture repellant agents.

TABLE 1

| | I | II | III | IV |
|---|---|---|---|---|
| Dispersant | 0.5 | 0.5 | 0.5 | 0.5 |
| Precipitated chalk | 80 | 80 | 80 | 80 |
| Aluminum hydroxide | 20 | 20 | 20 | 20 |
| Styrene-butadiene latex | 18 | 18 | 18 | 18 |
| Optical brightener | 1 | 1 | 1 | 1 |
| Ammonium stearate | 10 | | | |
| Wax dispersion I | | 10 | | |
| Wax dispersion II | | | 10 | |
| Prepolymer dispersion | | | | 10 |
| pH | 10.12 | 10.8 | 10.0 | 10.1 |
| Solid content | 36.8 | 36.9 | 37.8 | 37.8 |
| Viscosity 10 rpm | 15840 | 6360 | 2560 | 1940 |
| Brookfield 20 rpm | 9480 | 4160 | 1640 | 1380 |
| Spindle 5 50 rpm | 5112 | 2424 | 960 | 968 |
| 100 rpm | 3372 | 1732 | 836 | 736 |

The formulas of Examples I to IV were applied to a wood-free raw paper commonly used in the preparation of pressure-sensitive copy papers, sized in the mass and provided in the sizing press with a preparation of starch, of 48 $g/m^2$ weight per unit area, in the amount of 6 $g/m^2$, reckoned as dry substance. After application of the front face coating, drying and calendering, the actual microsphere coating was applied to the back and also dried.

With the test papers I to IV and commercial CFB and CF papers, so-called 4x sets were assembled in the order CB-CFB-CFB-CF, the sets were combined in blocks, and coated on one narrow margin with commercial easy-release adhesive. After a drying period of 24 hours the easy-release adhesive was tested by removing single sheets and full sets, and judged on the following scale:

1=very good function
2=good function
3=fair function
4=poor function
5=unusable

The judgment was as follows:

| Example | I | II | III | IV |
|---|---|---|---|---|
| Evaluation | 1 | 1 | 1-2 | 2 |

The whiteness and opacity measured according to DIN standards on the first sheets are listed in Table II, and in addition to the whiteness measurements a visual evaluation on a scale of 1=good to 10=poor was performed.

TABLE II

| | | Elrepho | | | |
|---|---|---|---|---|---|
| Example | Opacity | Whiteness with UV | Whiteness w/o UV | Lange whiteness | Visual impression |
| I | 83 | 91.6 | 79.4 | 90.8 | 4 |
| II | 82 | 98.9 | 85.8 | 96.9 | 1 |
| III | 81 | 93.8 | 81.6 | 90.8 | 6 |
| IV | 83 | 90.2 | 78.2 | 87.8 | 3 |
| Example for comparison, microsphere coating only | 75 | 98.5 | 85.0 | 94.6 | 10 |

I claim:

1. In a first sheet for copysets of pressure-sensitive copy papers, said first sheet comprising a microsphere coating on the back and an imprintable coating on the front, said imprintable coating consisting essentially of non-reactive, natural or synthetic pigments, a binder, a moisture repellent agent, a dispersant and an optical brightener, wherein the improvement comprises providing the front surface imprintable coating with a non-reactive moisture repellant agent in an amount of 5 to 15% by weight, based on the dry content of said front surface coating.

2. A first sheet of claim 1, wherein the non-reactive moisture repellent agent is a salt of a fatty acid or of a wax, a wax ester in admixture with an oxidized polyethylene, a montan wax or a mixture of two or more of these.

3. A first sheet of claim 2, wherein the salt of a fatty acid is a calcium, sodium, zinc or ammonium salt.

4. A first sheet of claim 3, wherein the fatty acid is stearic acid.

5. A first sheet of claim 1, wherein the front face coating contains as natural pigment ground and/or precipitated calcium carbonate, kaolin, calcined kaolin, talc or a mixture of these substances.

6. A first sheet of claim 5, wherein the proportion of the natural pigment consists of 70 to 90 weight-parts per 100 weight-parts of dry pigment.

7. A first sheet of claim 1, wherein said synthetic pigment is precipitated silica.

* * * * *